United States Patent [19]

Wiesinger et al.

[11] Patent Number: 4,485,837

[45] Date of Patent: Dec. 4, 1984

[54] SUPPORTING AND GUIDING ARC FOR A CAST STRAND

[75] Inventors: Horst Wiesinger; Günter Holleis; Werner Scheurecker, all of Linz; Walter Antonitsch, Kematen, all of Austria

[73] Assignee: Voest-Alpine Aktiengesellschaft, Linz, Austria

[21] Appl. No.: 411,693

[22] Filed: Aug. 26, 1982

[30] Foreign Application Priority Data

Sep. 17, 1981 [AT] Austria ..... 4016/81

[51] Int. Cl.[3] ..... B22D 11/12

[52] U.S. Cl. ..... 164/448; 164/442

[58] Field of Search ..... 164/442, 448, 484

[56] References Cited

U.S. PATENT DOCUMENTS

| | | | |
|---|---|---|---|
| 3,710,847 | 1/1973 | Schoffmann | 164/442 |
| 3,794,107 | 2/1974 | Bollig et al. | 164/442 |
| 4,015,656 | 4/1977 | Scheinecker | 164/442 |
| 4,046,188 | 9/1977 | Kagerhuber et al. | 164/448 |
| 4,116,262 | 9/1978 | Kagerhuber et al. | 164/448 |
| 4,223,715 | 9/1980 | Streubel | 164/448 |
| 4,300,619 | 11/1981 | Scheurecker | 164/442 |
| 4,342,358 | 8/1982 | Guse | 164/448 |
| 4,351,383 | 9/1982 | Gladwin | 164/442 |
| 4,358,007 | 11/1982 | Scheurecker | 164/442 |
| 4,362,206 | 12/1982 | Cordella | 164/442 |

*Primary Examiner*—Nicholas P. Godici
*Assistant Examiner*—P. Weston Musselman, Jr.
*Attorney, Agent, or Firm*—Brumbaugh, Graves, Donohue & Raymond

[57] ABSTRACT

In a supporting and guiding arc for cast strands including rollerways supporting the strand on opposite sides, the rollers are mounted on one-piece arcuate longitudinal carriers extending over the total length of the guiding arc. Transverse carriers are arranged in pairs opposite each other along the arcuate longitudinal carriers at a distance from one another, engaging the arcuate longitudinal carriers from behind and being connected by drawing anchors. In order to combine the advantages of guiding arcs assembled of segments arranged in series with the advantages of guiding arcs equipped with continuous arcuate longitudinal carriers, each rollerway has only two arcuate longitudinal carriers. A plurality of supporting segments are inserted between the arcuate longitudinal carriers and are detachably fastened to the same. A plurality of rollers allocated to a rollerway are journaled on each supporting segment. After detachment of a supporting segment from the arcuate longitudinal carriers, the supporting segment is removable from the supporting and guiding arc, together with its rollers.

18 Claims, 5 Drawing Figures

SUPPORTING AND GUIDING ARC FOR A CAST STRAND

BACKGROUND OF THE INVENTION

The invention relates to a supporting and guiding arc for cast strands, in particular for cast strands with slab cross section, comprising rollerways supporting the strand on opposite sides, the rollers of which are mounted on one-piece arcuate longitudinal carriers extending over the total length of the guiding arc, wherein transverse carriers arranged in pairs opposite each other are provided along the arcuate longitudinal carriers at a distance from one another, engaging the arcuate longitudinal carriers from behind and being connected by drawing anchors.

A supporting and guiding arc of this kind is known from U.S. Pat. Nos. 4,046,188, 3,710,847, and 4,116,262.

Such a one-part supporting and guiding arc, compared to a guiding arc assembled of a plurality of segments arranged in series and individually mounted on the base, has the advantage that it avoids the transitions from segment to segment, which must be accurately aligned relative to one another. By using continuous one-piece arcuate longitudinal carriers, the rollers rest on predetermined curve paths without points of discontinuity.

When projecting continuous casting plants to be included in existing halls, the manipulation of the continuous casting-arc possibly may cause difficulties, since it may, for instance, be necessary to detach the inner arc from the outer arc when exchanging rollers.

The invention aims at avoiding these difficulties and has as its object to provide a supporting and guiding arc of the initially-defined kind, which, on preserving the advantages of the known supporting and guiding arcs equipped with continuous arcuate longitudinal carriers, allows for a roller exchange during which only relatively low weights and small structural units must be manipulated, as is the case with supporting and guiding arcs assembled of segments arranged in series. Thus, the advantages of guiding arcs assembled of segments arranged in series are to be combined in one structure with the advantages of guiding arcs equipped with continuous arcuate longitudinal carriers.

SUMMARY OF THE INVENTION

This object is achieved by the combination of the following characteristic features:

- each rollerway comprises only two arcuate longitudinal carriers arranged at a distance larger than the longitudinal extension of the rollers laterally of the roller ends;
- a plurality of supporting segments are inserted between the arcuate longitudinal carriers;
- the supporting segments are detachably fastened to the arcuate longitudinal carriers;
- a plurality of rollers allocated to a rollerway are journaled on each supporting segment;
- after detachment of a supporting segment from the arcuate longitudinal carriers, the supporting segment is removable from the supporting and guiding arc, together with its rollers.

By arranging the two arcuate longitudinal carriers laterally of the ends of the rollers, it is possible to move the supporting segments between the arcuate longitudinal carriers and along the same (for the purpose of removal and installation).

According to a preferred embodiment, a free space that extends over the total length of the supporting and guiding arc is provided between the arcuate longitudinal carriers, the supporting segments and the transverse carriers, through which the supporting segments plus installed rollers are movable along the arcuate longitudinal carriers after detachment from the same, which offers the advantage that the supporting segments can be removed from the supporting and guiding arc, and installed into the supporting and guiding arc, not one after the other, but in any desired order. It is also possible to remove, and install, a single middle segment without having to detach the remaining segments from the supporting and guiding arc.

Suitably, the supporting segments are detachably fastened to the arcuate longitudinal carriers by means of quicklocks, the quicklock advantageously being designed as a pin retractable, preferably hydraulically retractable, into the supporting segments.

Suitably, the supporting segments are formed by longitudinal carriers carrying roller holding means or roller bearings and connected by, preferably, hollow tube-shaped carriers extending parallel to the rollers, the retractable pins being displaceably mounted in the hollow carriers.

According to a preferred embodiment, the quicklock is designed as a rotatable slotted bush inserted in the arcuate longitudinal carriers and a holding pin fastened to the supporting segment and insertable into this bush via its slot.

For a simple installation and removal of the supporting segments, a grab car guided along the arcuate longitudinal carriers is movable in the free spaces of the arc inner and arc outer sides, on which grab car grab means for seizing the supporting segments are provided.

Suitably, a transporting car accommodating the grab car is guided below the working platform at the height of the strand section (bending zone) following upon the mould.

For seizing the supporting segments, the grab car suitably comprises pivot arms that are placeable into and out of engagement with a supporting segment, which pivot arms advantageously are designed as angle levers.

In order to prevent jamming of the supporting segments during installation and removal, guides are provided on the arcuate longitudinal carriers for the supporting segments.

For the guidance of the grab car, guide rails are provided along the arcuate longitudinal carriers, according to a preferred embodiment.

BRIEF DESCRIPTION OF THE DRAWINGS

The invention will now be explained in more detail by way of exemplary embodiments and with reference to the accompanying drawings, wherein.

DESCRIPTION OF EXEMPLARY EMBODIMENTS

Figure 1:
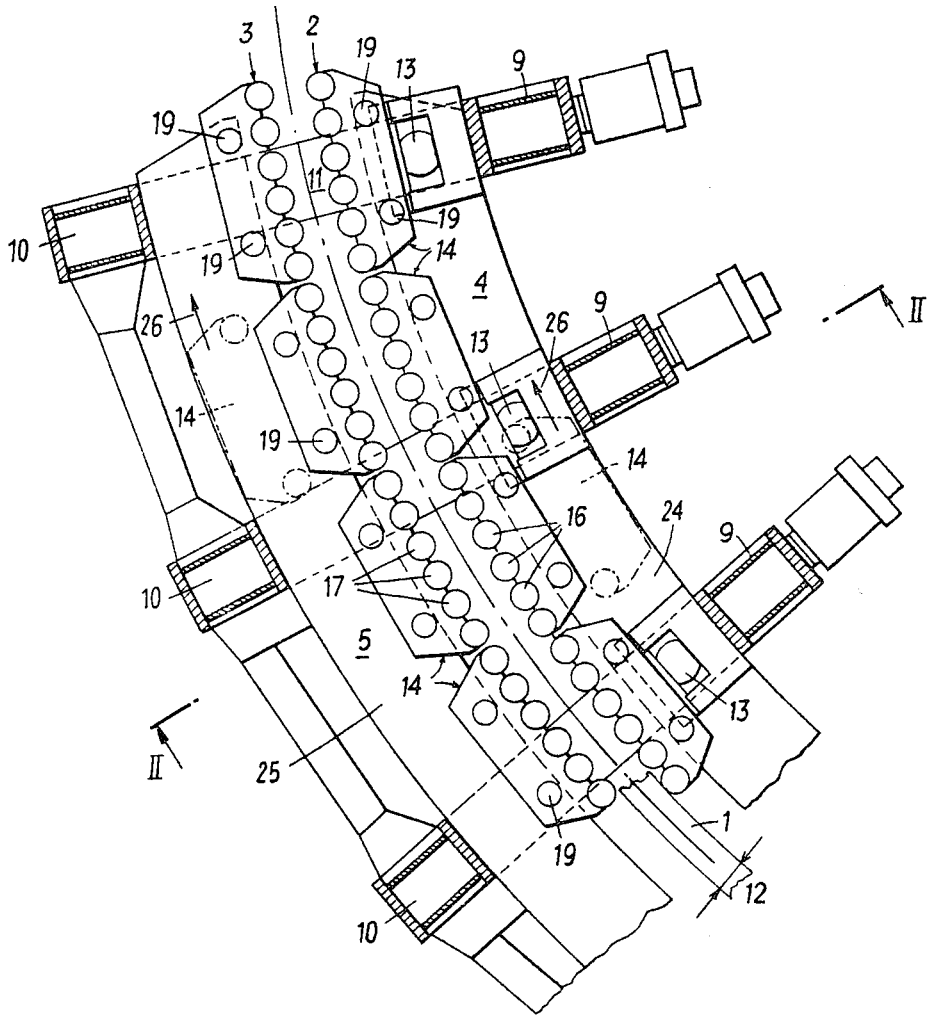
FIG. 1 is a schematically illustrated section through the supporting and guiding arc in the arc plane.

A cast strand 1 is extracted from a mould (not illustrated) and bent in a bending zone (not illustrated) arranged below the mould. Subsequently, the strand is guided between an arc inner rollerway 2 and an arc outer rollerway 3 of a supporting and guiding arc from the nearly perpendicular line to the nearly horizontal line. After the guiding arc a straightening zone (not illustrated) is arranged, following the extraction direction of the strand, in which the strand is straightened again.

Each of the rollerways 2, 3 comprises two continuous arcuate longitudinal carriers 4, 5 extending over the total length of the supporting and guiding arc and each arranged laterally of the roller ends 8 at a distance 6 that is larger than the length 7 of the rollers. Along the arc outer side arcuate longitudinal carriers 5 and the arc inner side arcuate longitudinal carriers 4, transverse carriers 9, 10 are arranged at distances from each other, which engage the parallelly arranged arcuate longitudinal carriers from behind, two opposite transverse carriers each being clamped relative to each other by means of drawing anchors 11 to accommodate ferrostatic forces. The drawing anchors 11, furthermore, keep the rollerways 2 and 3 at a certain distance that corresponds to the thickness 12 of the strand 1 to be cast. The latticework or framework formed by the transverse carriers and the arcuate longitudinal carriers is mounted on the base on at least two points of its longitudinal extension, i.e. either via an expansion bearing and a fixed bearing or via a fixed bearing and several expansion bearings (for instance, according to U.S. Pat. No. 4,116,262) (not illustrated in the drawings).

The arcuate longitudinal carriers 4 of the arc inner rollerway 2 are movably mounted on the transverse carriers 9 by means of sliding bricks 13 in order to enable the adjustment of different strand thicknesses. For this purpose, the transverse carriers 9 of the arc inner rollerway 2 are displaced along the drawing anchors 11 and the arcuate longitudinal carriers are elastically deformed, as is described and illustrated, for instance, in U.S. Pat. No. 4,046,188.

Figure 2:
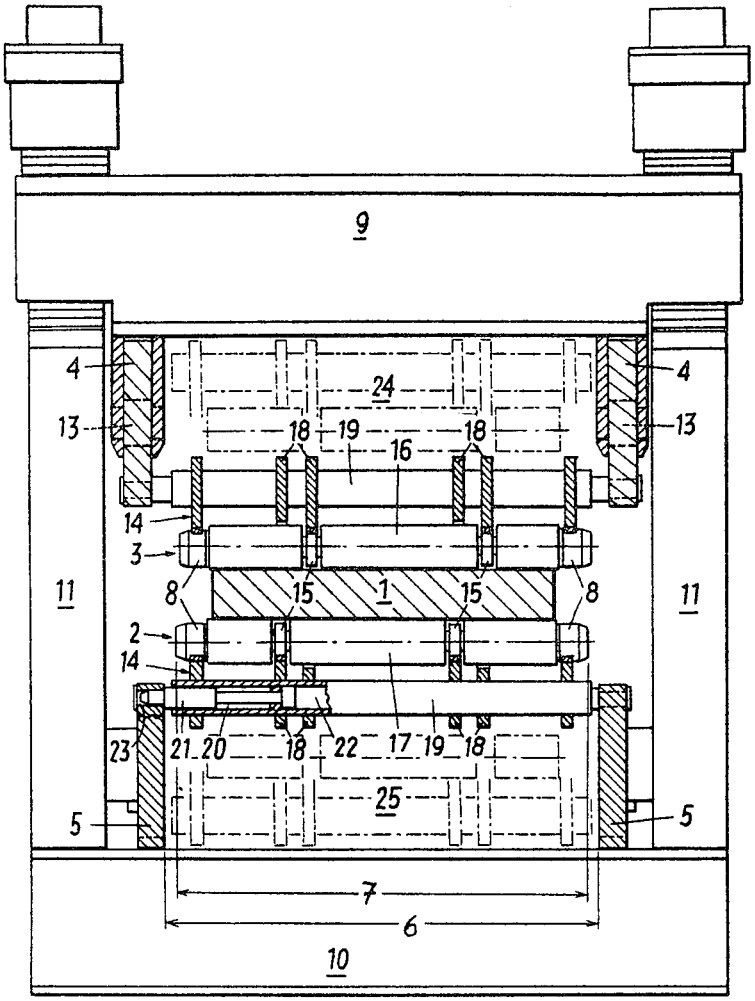
FIG. 2 illustrates a section according to line II—II of FIG. 1.

Between the arcuate longitudinal carriers 4 and 5 of each of the rollerways 2 and 3, supporting segments 14 arranged in series are inserted and detachably fastened to the arcuate longitudinal carriers. Each of the supporting segments 14, via roller holding means 15, carries a plurality of rollers 16 and 17, respectively, allocated to a rollerway. Each supporting segment is formed by longitudinal carriers 18 carrying the roller holding means 15, the rollers being supported several times over their longitudinal extension. These longitudinal carriers 18 are penetrated by carriers 19 extending parallel to the rollers. These carriers are tube-shaped, comprising pins 21 on their ends, which are inserted in their cavities 20. These pins are displaceable in the direction of the longitudinal axes of the carriers 19 by means of hydraulic cylinders 22, so that they can be brought from a position projecting from the carriers, as is illustrated in FIG. 2, into a position in which they are entirely retracted or pulled back into the carriers. By means of these pins 21, the supporting segments 14 are connected to the arcuate longitudinal carriers 4, 5 in a quickly and easily detachable manner, the ends of the pins 21 being insertable into the bores 23 of the arcuate longitudinal carriers, and removable therefrom.

Between the supporting segments 14, the arcuate longitudinal carriers 4 and 5, and the transverse carriers 9 and 10, respectively, a free space 24 and 25, respectively, is provided, extending over the total length of the supporting and guiding arc, through which space the supporting segments 14 plus installed rollers are movable along the arcuate longitudinal carriers 4 and 5 after detachment from the same. In FIGS. 1 and 2 a supporting segment is illustrated in dot-and-dash lines, which has been displaced into the free space 24. The removal direction is illustrated by the arrow 26. To perform this movement in the direction of the arrow 26, guide means and traction means (not illustrated) are provided, for instance rails and rope or chain hoists. The removal of an arc outer supporting segment along the space 25 is illustrated in FIGS. 1 and 2 also in dot-and-dash lines.

Opposite supporting segments are not in direct contact with each other so that the arrangement of the supporting segment may be chosen freely, i.e. the supporting segments need not be located precisely opposite each other, but it is also possible to arrange the arc outer supporting segments so as to be set-off relative to the arc inner supporting segments in the longitudinal direction of the supporting and guiding arc.

Figure 3:
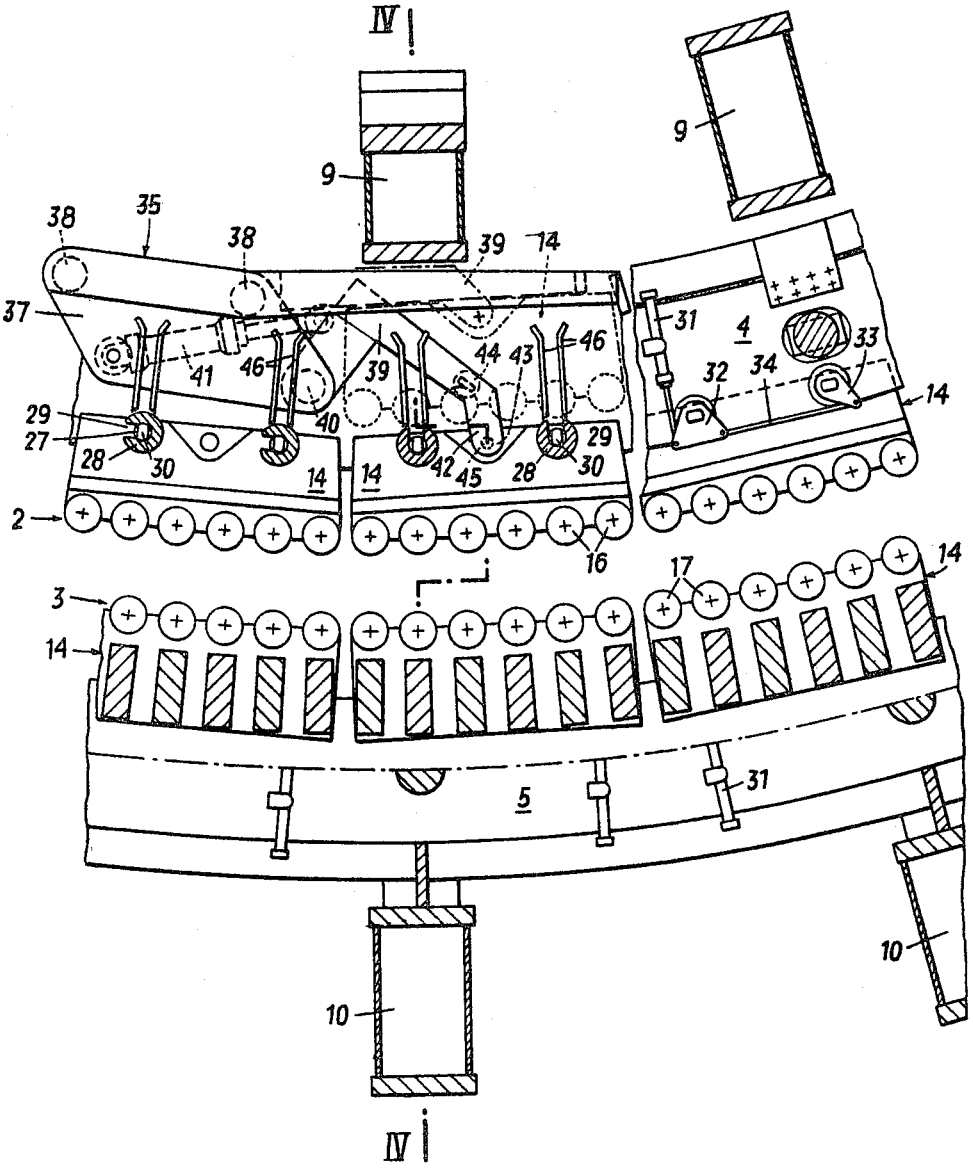
FIGS. 3 to 5 represent a further embodiment in illustrations analogous to FIGS. 1 and 2, FIG. 3 being a sectional representation laid in two planes, i.e. according to lines III—III and III'—III' of FIG. 4, and FIG. 5 being a side view.
Figure 4:
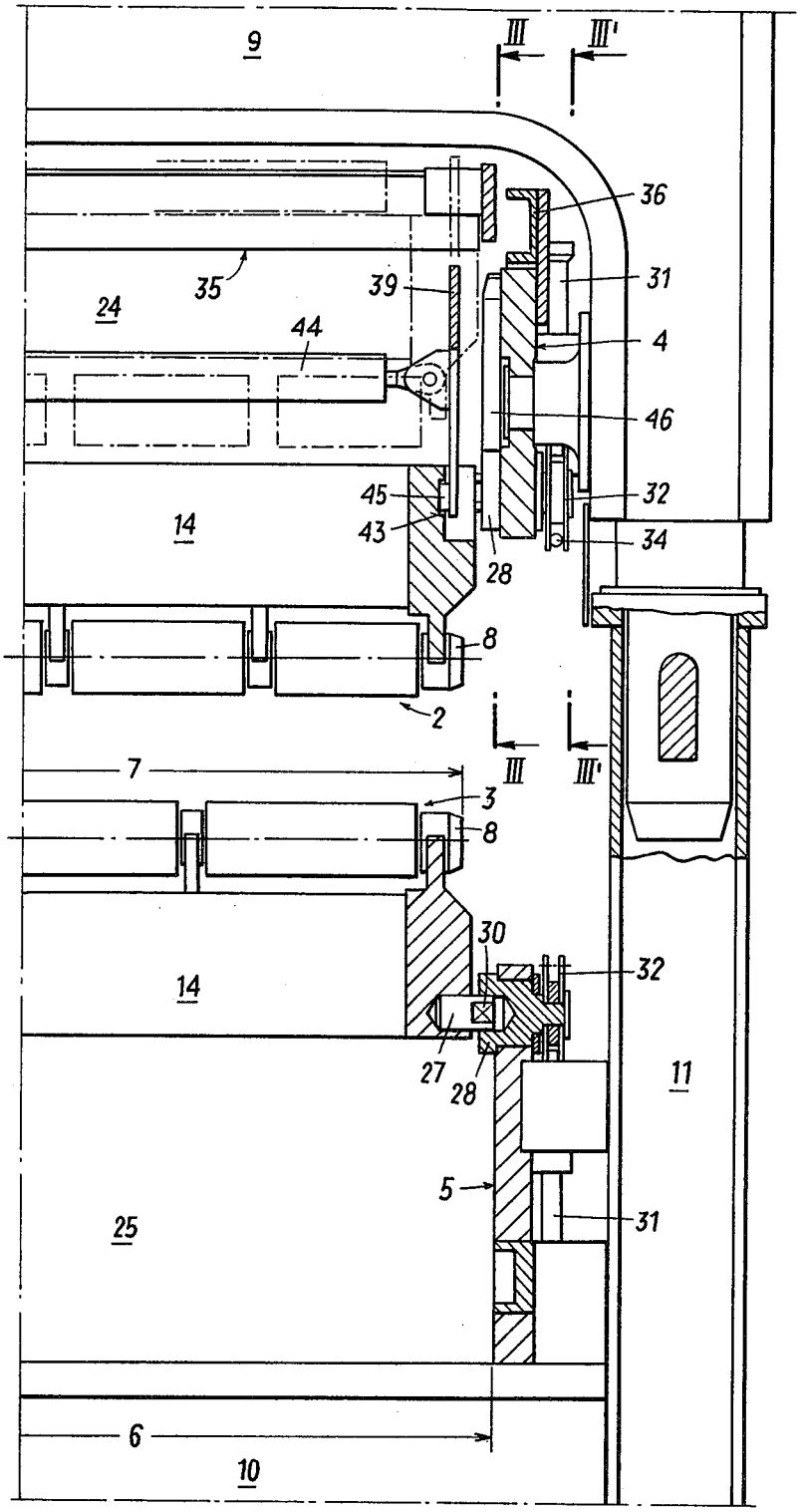

In FIGS. 3 and 4 a further embodiment is illustrated. The fastening of the supporting segments 14 to the arcuate longitudinal carriers 4 is modified in this case; it comprises holding pins 27 inserted in the supporting segments and laterally cantilevered from the supporting segments. Rotatable bushes 28 accommodating the holding pins 27 are inserted into the arcuate longitudinal carriers 4 and 5. These bushes 28 each have a slot 29 through which the holding pins may emerge with flattened end pieces 30. The bushes are rotatable from the holding position illustrated in FIG. 3 on the left side into the removal position illustrated in FIG. 3 on the right side, by means of a pressure medium cylinder 31 mounted laterally on the arcuate longitudinal carriers. The bushes, which serve for holding a supporting segment 14, are connected with each other by means of levers 32, 33 and rods 34, so that they can be actuated synchronously by means of the pressure medium cylinder 31.

For the removal and installation of the supporting segments, a grab car 35 is provided in the embodiment illustrated in FIGS. 3 and 4, which is movable along guide rails 36 through the free spaces 24, 25 formed by the arcuate longitudinal carriers 4 and 5, respectively, the supporting segments 14 and the transverse carriers 9 and 10, respectively. In these guide rails, the grab car is rolling with laterally cantilevered rollers (not illustrated). The grab car 35 comprises two side cheeks 37 directed parallel to the arcuate longitudinal carriers 4 and 5, respectively, and coming to lie closely beside the same, which side cheeks are connected into a cage by cross beams 38. On the front end of the grab car 35, two angle levers 39 are mounted so as to be pivotable about an axis 40 parallel to the roller axes. A pressure medium cylinder 41 serves to carry out the pivot movement. The front end 42 of each of these levers is hookable into a recess 43 arranged in the symmetrical plane of a supporting segment 14. This is effected by actuating a pressure medium cylinder 44 connecting the two angle levers 39. This pressure medium cylinder 44 allows for pulling the two angle levers towards each other in the direction of the pivot axis 40 and straddling the same, whereby a projection 45 arranged on the end 42 of each angle lever 39 is placeable into and out of engagement with the recess 43 of the supporting segment. Preferably, the angle levers 39 are resilient relative to each other, being straddled by the pressure medium cylinder 44 by elastic deformation. In FIG. 4 the position is drawn in which a supporting segment is clamped between the angle levers, i.e. laterally braced by the same and held by the projections of the angle levers.

Guides 46 located laterally of the supporting segments 14 are provided on the arcuate longitudinal carriers 4 and 5, respectively, aligning the supporting segments 14 when they are inserted into the plant, so that the newly inserted supporting segment, with its holding pins 27, is insertable into the bushes 28 precisely through the slots 29. The grab car 35 is movable along the guide rails 36 by means of a rope or chain hoist (not illustrated). In FIG. 3 a supporting segment 14 is drawn in dot-and-dash lines that has been brought into the free space 24 formed by the arcuate longitudinal carriers, the supporting segments and the transverse carriers, with the help of the angle levers 39 of the grab car also drawn in dot-and-dash lines. As soon as the supporting segment has assumed this position, it can be moved out of the plant by displacement of the grab car along the arcuate longitudinal carriers 4 and 5.

Figure 5:
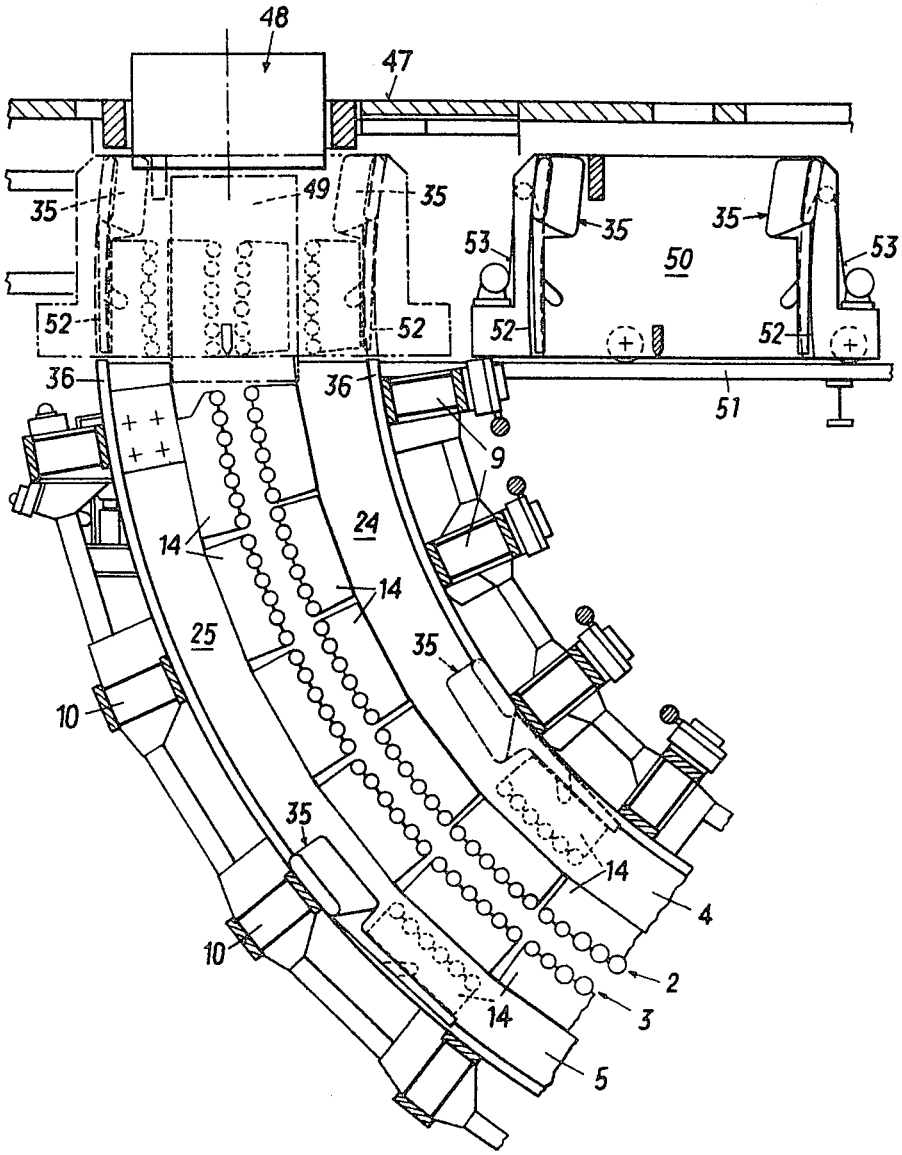

As can be seen from FIG. 5, a transporting car 50 accommodating two grab cars is guided on rails 51 below the working platform 47 of the continuous casting plant at the height of the strand section following upon the mould 48, which, in case of straight moulds, is designed as the bending zone 49, as is illustrated in FIG. 5 in dot-and-dash lines. This transporting car, when moved into the position shown in FIG. 5 in broken lines after the removal from the bending zone, includes two guide rails 52 registering with the guide rails 36. Each of the two grab cars 35 is allocated to one of the free spaces 24 and 25. In the transporting car 50, rope or chain hoist 53 are installed, by means of which the grab cars 35 can be lowered into the supporting and guiding arc and retracted out of the same.

What we claim is:

1. In a supporting and guiding arc for a cast strand, such as a strand having a slab cross section, including an arc-inner roller way and an arc-outer roller way, each having rollers supporting said strand on opposite sides thereof, one-piece arcuate longitudinal carries extending over the total length of said supporting and guiding arc and accommodating said roller ways, pairs of transverse carriers arranged opposite from one another and engaging said longitudinal-carriers from a side of said longitudinal carriers opposite said roller ways, and pairs of transverse carriers being arranged at distances from one another along said longitudinal carriers, and drawing anchors connecting said opposite pairs of transverse carriers, the improvement wherein each of said arc-inner roller way and said arc-outer roller way comprises:

only two one-piece arcuate longitudinal carriers arranged laterally of the ends of said rollers at a distance larger than the longitudinal extension of said rollers, a plurality of supporting segments, each of said supporting segments having a plurality of said strand supporting rollers mounted thereon, and means for separately detachably fastening each of said supporting segments to the two longitudinal carriers of its respective roller way in a strand supporting position, any individual one of said segments upon detachment from its respective pair of longitudinal carriers being removable from said supporting and guiding arc by withdrawal away from its strand supporting position between said longitudinal carriers.

2. A supporting and guiding arc as set forth in claim 1, wherein said means for separately detachably fastening each of said supporting segments to said arcuate longitudinal carriers comprise quicklocks.

3. A supporting and guiding arc as set forth in claim 2, wherein each of said quicklocks includes a pin retractable into the pertaining supporting segment.

4. A supporting and guiding arc as set forth in claim 3, wherein said pin is hydraulically retractable.

5. A supporting and guiding arc as set forth in claim 2, wherein each of said quicklocks is comprised of a rotatable bush provided with a slot and inserted in the pertaining arcuate longitudinal carrier, and of a holding pin fastened to said supporting segment and insertable into said bush through said slot.

6. A supporting and guiding arc as set forth in claim 3, wherein said supporting segments, are formed by longitudinal carriers carrying roller holding means, and further comprising hollow carriers for connecting said longitudinal carriers, said retractable pins being displaceably mounted in said hollow carriers.

7. A supporting and guiding arc as set forth in claim 1, further comprising free spaces provided between said arcuate longitudinal carriers, said supporting segments when in said strand supporting position, and said transverse carriers, said free spaces extending over the total length of said supporting and guiding arc, wherein said supporting segments, after detachment from said arcuate longitudinal carriers, are movable through said free spaces along the length of said arcuate longitudinal carriers.

8. A supporting and guiding arc as set forth in claim 7, wherein said free spaces are provided on each of the arc inner and arc outer sides, and which further comprises a grab car guided along said arcuate longitudinal carriers and movable in said free spaces, grab means being provided on said grab car for seizing said supporting segments.

9. A supporting and guiding arc as set forth in claim 8, further comprising pivot arms provided on said grab car and adapted to be brought into and out of engagement with a supporting segment.

10. A supporting and guiding arc as set forth in claim 9, further comprising an adjustment means for bringing two of said pivot arms towards and away from each other and thus into and out of engagement with said supporting segment.

11. A supporting and guiding arc as set forth in claim 10, wherein said pivot arms are designed to be resilient relative to each other and adapted to be brought out of engagement with said supporting segment by means of said adjustment means under elastic deformation of said supporting segment.

12. A supporting and guiding arc as set forth in claim 9, wherein said pivot arms are designed as angle levers.

13. A supporting and guiding arc as set forth in claim 8, further comprising guides provided on said arcuate longitudinal carriers for said supporting segments.

14. A supporting and guiding arc as set forth in claim 8, comprising a working platform, a mould and a strand guiding section following upon said mould, and further comprising a transporting car adapted to accommodate said grab car, said transporting car being guided below said working platform at the height of said strand guiding section following upon said mould.

15. A supporting and guiding arc as set forth in claim 8, further comprising guide rails provided along said arcuate longitudinal carriers for said grab car.

16. A supporting and guiding arc as set forth in claim 1, wherein each of said supporting segments comprises (a) longitudinal carriers carrying roller holding means, and (b) further carriers for connecting said supporting segment longitudinal carriers.

17. A supporting and guiding arc as set forth in claim 1, wherein each of said supporting segments comprises (a) longitudinal carriers carrying roller bearings, and (b) further carriers for connecting said supporting segment longitudinal carriers.

18. A supporting and guiding arc as set forth in claim 16 or 17, wherein said further carriers are hollow tube-shaped carriers extending parallel to said rollers.

* * * * *

UNITED STATES PATENT AND TRADEMARK OFFICE

CERTIFICATE OF CORRECTION

PATENT NO. : 4,485,837

DATED : Dec. 4, 1984

INVENTOR(S) : Wiesinger et al.

It is certified that error appears in the above-identified patent and that said Letters Patent is hereby corrected as shown below:

Col. 5, line 47, "carries" should read --carriers--.

Signed and Sealed this

*Seventh* Day of *May 1985*

[SEAL]

*Attest:*

DONALD J. QUIGG

*Attesting Officer* *Acting Commissioner of Patents and Trademarks*